United States Patent [19]

Reed et al.

[11] Patent Number: 4,908,263

[45] Date of Patent: Mar. 13, 1990

[54] NONWOVEN THERMAL INSULATING STRETCH FABRIC

[75] Inventors: John F. Reed, Arden Hills; Daniel E. Meyer, Stillwater; Thomas P. Hanschen, St. Paul, all of Minn.

[73] Assignee: Minnesota Mining and Manufacturing Company, St. Paul, Minn.

[21] Appl. No.: 193,779

[22] Filed: May 13, 1988

[51] Int. Cl.[4] ..... B32B 27/00

[52] U.S. Cl. ..... 428/286; 428/287; 428/288; 428/296; 428/360; 428/362; 428/370; 428/401; 428/903

[58] Field of Search ..... 428/286, 287, 288, 296, 428/360, 362, 370, 401, 903

[56] References Cited

U.S. PATENT DOCUMENTS

| | | | |
|---|---|---|---|
| 4,065,599 | 12/1977 | Nishiumi et al. | 428/402 |
| 4,100,324 | 7/1978 | Anderson et al. | 428/288 |
| 4,118,531 | 10/1978 | Hauser | 428/224 |
| 4,209,563 | 6/1980 | Sisson | 428/288 |
| 4,259,400 | 3/1981 | Bolliand | 428/288 |
| 4,379,192 | 4/1983 | Wahlquist et al. | 428/156 |
| 4,392,903 | 7/1983 | Endo et al. | 156/167 |
| 4,418,103 | 11/1983 | Tani et al. | 428/4 |
| 4,429,001 | 1/1984 | Kolpin et al. | 428/283 |
| 4,438,172 | 3/1984 | Katsutoshi et al. | 428/220 |
| 4,551,378 | 11/1985 | Carey, Jr. | 428/198 |
| 4,588,635 | 5/1986 | Dosovan | 428/288 |
| 4,600,605 | 7/1986 | Nakai et al. | 427/379 |
| 4,618,531 | 10/1986 | Marcus | 428/283 |
| 4,660,228 | 4/1987 | Ogawa et al. | 2/167 |
| 4,692,368 | 9/1987 | Taylor et al. | 428/137 |
| 4,692,371 | 9/1987 | Morman et al. | 428/224 |
| 4,707,398 | 11/1987 | Boggs | 428/224 |

OTHER PUBLICATIONS

Development of Spunbonded Based on Thermoplastic Polyurethane *Nonwoven World*, May–Jun., 1986, pp. 79–81.

*Primary Examiner*—Marion C. McCamish

*Attorney, Agent, or Firm*—D. M. Sell; W. N. Kirn; C. Truesdale

[57] ABSTRACT

A nonwoven thermal insulating stretch fabric is provided. The fabric comprises 10 to 90 weight percent elastomeric melt blown microfiber web, the microfibers having an average diameter of less than about 25 micrometers, and 10 to 90 weight percent crimped bulking fibers. The microfibers are bonded to the bulking fibers at points of contact and the fabric has substantially uniform stretch properties such that the fabric will recover to at least 90 percent of the original dimensions within one hour after being elongated to 125 percent of the original length.

17 Claims, No Drawings

NONWOVEN THERMAL INSULATING STRETCH FABRIC

BACKGROUND OF THE INVENTION

1. Field of the Invention

The present invention relates to stretchable insulation fabrics which are particularly useful in thin, close-fitting garment applications.

2. Background Information

A wide variety of natural and synthetic filling materials or thermal insulation applications, such as in outerwear, e.g., ski jackets and snowmobile suits, sleeping bags, and bedding, e.g., comforters and bedspreads, are known.

Natural feather down has found wide acceptance for thermal insulation applications, primarily because of its outstanding weight efficiency and resilience. However, down compacts and loses its insulating properties when it becomes wet and exhibits a rather unpleasant odor when exposed to moisture. Also a carefully controlled cleaning and drying process is required to restore the fluffiness and resultant thermal insulating properties to a garment in which the down has compacted.

There have been numerous attempts to prepare synthetic fiber-based substitutes for down which could have equivalent thermal insulating performance without the moisture sensitivity of natural down.

U.S. Pat. No. 4,065,599 (Nishiumi et al.) discloses synthetic filler material comprising spherical objects made up of filamentary material comprising spherical objects made up of filamentary material with a denser concentration of filaments near the surface of the spherical object than the filament concentration spaced apart from the surface.

U S. Pat. No. 4,118,531 (Hauser) discloses a thermal insulating material which is a web of blended small denier fibers with crimped bulking fibers which are randomly and thoroughly intermixed and intertangled with the small denier fibers. The crimped bulking fibers are generally introduced into a stream of blown small denier fibers prior to their collection. This web combines high thermal resistance per unit of thickness and moderate weight.

U.S. Pat. No. 4,259,400 (Bolliand) discloses a fibrous padding material simulating natural down, the material being in the form of a central filiform core which is relatively dense and rigid and to which are bonded fibers which are oriented substantially transversely relative to this core, the fibers being entangled with one another so as to form a homogeneous thin web and being located on either side of the core, substantially in the same plane.

U.S. Pat. No. 4,392,903 (Endo et al.) discloses a thermal insulating bulky product which has a structural make-up of substantially continuous, single fine filaments of from about 0.01 to about 2 denier which are stabilized in the product by a surface binder. Generally, the binder is a thermoplastic polymer such as polyvinyl alcohol or polyacrylic esters which is deposited on the filaments as a mist of minute particles of emulsion before accumulation of the filaments.

U.S. Pat. No. 4,418,103 (Tani et al.) discloses the preparation of a synthetic filling material composed of an assembly of crimped monofilament fibers having crimps located in mutually deviated phases, which fibers are bonded together at one end to achieve a high density portion, while the other ends of the fibers stay free.

U.S. Pat. No. 4,588,635 (Donovan) describes thermal insulating materials which are batts of plied card-laps of a blend of 80 to 95 weight percent of spun and drawn, crimped, staple, synthetic polymeric small denier fibers having a diameter of from 3 to 12 microns and 5 to 20 weight percent of synthetic polymeric staple macrofibers having a diameter of from more than 12, up to 50 microns.

U.S. Pat. No. 4,618,531 (Marcus) discloses polyester fiberfill having spiral-crimp that is randomly arranged and entangled in the form of fiberballs with a minimum of hairs extending from their surface, and having a refluffable characteristic similar to that of down.

U.S. Pat. No. 4,438,172 (Katsutoshi et al.) discloses a heat retaining sheet comprising at least a web in which fibers containing polybutylene terephthalate as at least one of their components and having a substantially undrawn definite fiber length are mutually bonded, and which has small area shrinkage in boiling water. The sheet is described as having excellent durability and heat retaining properties as well as being elastic with an especially high stretch recovery ratio and very soft and flexible.

U.S. Pat. No. 4,551,378 (Carey, Jr.) discloses a nonwoven thermal insulating stretch fabric which is produced from a web of bicomponent fibers bonded together by fusion of fibers at points of contact and thermally crimped in situ in the web. The fabric is described as having good uniformity, good thermal insulating properties.

U.S. Pat. No. 4,660,228 (Ogawa et al.) discloses a glove comprising two elastic sheet materials, at least one of which consists essentially of a selected elastic polyurethane nonwoven fabric which is relatively thin, elastic, air and moisture permeable, dimensionally and texturally stable, nonslip and dustproof. The polyurethane nonwoven fabric is obtained by a melt-blowing process.

U.S. Pat. No. 4,600,605 (Nakai) discloses a stretchable wadding with an apparent density of 0.005 to 0.05 g/cm$^3$ which is formed from a web of crimp potential fibers bonded together and shrunk by drying. The crimp potential fibers are preferably bonded to each other by spraying an adhesive onto the web and drying the adhesive before shrinking the fibers by drying. The fibers may also be needled before the adhesive is applied.

Ogawa, in an article entitled "Development of Spunbonded Based on Thermoplastic Polyurethane," *Nonwovens World*, May-June, 1986. pp 79–81, describes a spunbonded nonwoven polyurethane elastic fabric developed by Kanebo Ltd. The fabric is made using a melt blown process which is different from a conventional melt blown process to produce fabric which is similar to that of spunbonded fabrics. The diameter of its filaments is not so fine as that of the usual melt blown fabrics, i.e., 0.5–2 micrometers, but apparently is closer to that of the spunbonded fabrics, i.e., 20–50 micrometers. The elasticity, dust catching capability, low linting, high friction coefficient, air permeability and welding characteristics of the urethane fabrics are discussed in the article.

SUMMARY OF THE INVENTION

The present invention provides a nonwoven thermal insulating stretch fabric comprising 10 to 90 weight percent elastomeric melt blown small denier fiber web, the small denier fibers having an average diameter of less than about 25 micrometers, and 10 to 90 weight percent crimped bulking fibers, the small denier fibers being bonded to the bulking fibers at points of contact and the fabric having substantially uniform stretch properties such that the fabric will recover to within about 10 percent of the original dimensions within one hour after being elongated to 125 percent of the original length.

The elastomeric melt blown small denier fiber webs which provide an elastomeric matrix for the crimped bulking fibers, are made thicker and less dense by the addition of the crimped bulking fibers which are preferably uniformly distributed throughout the nonwoven web. The nonwoven thermal insulating stretch fabrics of the invention have improved elasticity, flexibility and softness. Additionally, the thermal insulation materials of the present invention have improved launderability and dry cleanability over conventional synthetic stretch thermal insulation materials, showing improved loft and thermal insulation properties after laundering or dry cleaning. The elasticity of the stretch thermal insulation fabrics of the present invention make them particularly suitable for applications involving thin, close fitting garments such as active sports wear, gloves etc.

DETAILED DESCRIPTION OF THE INVENTION

The elastomeric melt blown small denier fibers can be prepared from thermoplastic elastomeric materials such as, for example, elastomeric polyurethanes, elastomeric polyesters, elastomeric polyamides, elastomeric A-B-A' block copolymers wherein A and A' are styrenic moieties and B is an elastomeric midblock, and combinations thereof. Particularly preferred are elastomeric polyurethane materials. Preferably, the average diameter of the fiber is less than about 25 micrometers, more preferably between about 3 and 12 micrometers.

Suitable fibers for use as bulking fibers in the nonwoven thermal insulating stretch fabrics of the present invention include natural and synthetic staple fibers such as, for example, polyester, acrylic, polyolefin, polyamide, rayon, wool, and acetate staple fibers.

The bulking fibers preferably have an average of more than about one half crimp per centimeter and, more preferably, have an average crimp frequency of at least two crimps per centimeter. As a minimum, the bulking fibers should have an average length sufficient to include at least one complete crimp and preferably three to four crimps. The bulking fibers preferably have an average length of between about 2 and 15 cm, more preferable between 3.5 to 8 cm.

The bulking fibers preferably are at least about 1 denier, more preferably at least about 3 denier, most preferably about 6 denier, in size. Generally, the size of the bulking fiber is no greater than about 15 denier. Finer bulking fibers provide greater insulating efficiency, while fibers of greater diameter provide increased resistance to compression.

The nonwoven thermal insulating stretch fabric of the invention contains about 10 to 90 weight percent elastomeric melt blown small denier fibers and 10 to 90 weight percent crimped bulking fibers, preferably 25 to 75 weight percent elastomeric melt blown small denier fibers and 25 to 75 weight percent crimped bulking fibers. The amount of bulking fiber incorporated into the nonwoven thermal insulating stretch fabrics of the present invention depends on the particular use made of the web. As the amount of elastomeric melt blown small denier fibers increase, the strength and integrity, as well as the elasticity, of the fabric increase. When the amount of elastomeric melt blown small denier fibers is less than about 10 weight percent of the fabric, the strength and integrity of the fabric may be detrimentally affected. As the amount of bulking fiber increases, thermal insulating properties generally increase. When the amount of bulking fiber is less than 10 weight percent of the fabric, insufficient thermal insulating properties may result. For applications where very light weight webs having good crush resistance are required, the bulking fiber may account for as high as 90 weight percent of the composite web.

The nonwoven thermal insulating stretch fabrics of the invention preferably have a thermal resistance of at least about 0.9 clo/cm, more preferably at least about 1.5 clo/cm, most preferably at least about 1.8 clo/cm; a thermal insulating efficiency of at least about $8\times10^{-3}$ clo$-$m$^2$/g basis weight, more preferably at least about $11\times10^{-3}$ clo$-$m$^2$/g, most preferably at least about $14\times10^{-3}$ clo$-$m$^2$/g; and an elongation, which is at least 90 percent recoverable, of at least about 10 percent, more preferably at least about 25 percent, most preferably at least about 40 percent.

The nonwoven thermal insulating stretch fabrics of the invention preferably recover to at least about to within 10% percent, more preferably at least about to within 1% percent of the original dimensions within one hour after being elongated to 125 percent of the original length and preferably retain at least 50 percent, more preferably at least 75 percent, of the original thickness and thermal insulation efficiency after laundering or dry cleaning.

The force required to stretch the fabric 40 percent is preferably at least about 200 g, more preferably at least about 400 g, most preferably at least about 750 g.

The nonwoven thermal insulating nonwoven fabrics of the invention can be prepared by a process similar to that taught in U.S. Pat. No. 4,118,531 (Hauser), which is incorporated herein by reference for that purpose, except that a lower primary air pressure and a circular orifice die is used. The thermoplastic elastomeric materials are extruded through the die into a high velocity stream of heated air which draws out and attenuates the fibers prior to their solidification and collection. Alternatively, the thermoplastic elastomeric materials can be extruded from two dies as taught in U.S. Pat. No. 4,429,001 (Kolpin et al.) which is incorporated hereby by reference.

The crimped bulking fibers are loaded into the melt blown web by gently introducing a secondary air stream having the crimped bulking fibers dispersed therein into a primary air stream carrying the extruded fibers at a point where the fibers are still in a tacky condition in a process similar to that taught in Hauser. The secondary air stream preferably has a velocity of from about 10 to about 50 m/sec and intersects the primary air stream, which preferably has a velocity of from about 100 to about 180 m/sec, in a substantially perpendicular manner.

The resulting fiber stream of elastomeric small denier fibers and bulking fibers is collected in a random fashion prior to complete fiber solidification so that the tacky melt blown fibers can bond to one another and to the crimped bulking fibers to form a coherent web which has excellent stretch and tensile properties. Where additional bonding of the fibers is desired, the web can be heated in an oven.

This invention is further illustrated by the following examples, but the particular materials and amounts thereof recited in these examples, as well as other conditions and details, should not be construed to unduly limit this invention.

In the examples, all parts and percentages are by weight unless otherwise specified. In the examples, the thermal resistance was determined using a Rapid-K TM test unit, available from Dynatech R&D Company, Cambridge, MA. The force to stretch the fabrics 40 percent were determined on 10.2 cm wide test samples using an Thwing-Albert TM model QCII tensile tester, available from Thwing-Albert, at a gauge length of 15.2 cm and a crosshead speed of 127 cm/min with jaws 3.8 cm wide.

The fabric thickness was determined by applying a first compression force of 0.01 psi (0.069 kPa) to a 30.5 $cm^2$ sample of fabric for 30 seconds, removing the first compression force and allowing the fabric to recover for 30 seconds, and then applying a second compression force of 0.002 psi (0.014 kPa) and measuring the fabric thickness while the fabric is under the second compression force.

The thermal resistance is determined using a clometer apparatus similar to the guarded hot plate described in ASTM Test Method D1518 except that a standard plate constant of 0.8 clo is used and air velocity is minimized. A 50 cm×50 cm sample of fabric is placed on the hot plate and the plate temperature is maintained at 45° C. The heat transfer from the hot plate through the fabric is measured using a heat flow meter.

EXAMPLES 1–22

In Example 1, an elastomeric, nonwoven, melt-blown, small denier fiber web was prepared using thermoplastic elastomeric polyurethane polymer (PS 440-200, a polyesterurethane available from K.J. Quinn Co., Malden, MA) and polyester bulking fiber having the denier and crimp frequency set forth in Table I in the amounts set forth in Table I. The webs were prepared using a melt blowing process similar to that taught in U.S. Pat. No. 4,188,531 (Hauser) except that the melt-blowing die had circular smooth surfaced orifices (10/cm) with a 5:1 length-to-diameter ratio. The die temperature was maintained at 230° C., the primary air temperature and pressure were, respectively, 240° C. and about 50 kPa, (0.064 cm gap width), and the polymer throughput rate was 150 gm/hr/cm. The resulting average diameter of the small denier fibers was about 8 micrometers.

The secondary air stream containing the bulking fibers was introduced into the primary air stream carrying the extruded fibers at a point where the fibers were still in a tacky condition. The secondary air stream intersected the primary air stream in a substantially perpendicular manner.

The resulting air stream of elastomeric small denier fibers and bulking fibers was collected on a rotating perforated screen cylinder prior to complete small denier fiber solidification to permit bonding of the small denier fibers with one another and with the polyester bulking fibers.

In Examples 2–22, elastomeric nonwoven webs were prepared as in Example 1, except that the staple fiber type and content and the basis weight were varied as set forth in Table I and in Examples 9–10 and 20–22, a different polyesterurethane resin, PS 455–200, also available from K.J. Quinn Co., was substituted for the PS 440–200.

TABLE I

| | small denier fiber | Crimped bulking fiber | |
|---|---|---|---|
| Example | (wt %) | (wt %) | denier |
| 1 | 65 | 35 | 2.5 |
| 2 | 65 | 35 | 6 |
| 3 | 65 | 35 | 6 |
| 4 | 65 | 35 | 6 |
| 5 | 65 | 35 | 6 |
| 6 | 28.4 | 71.6 | 6 |
| 7 | 37.2 | 62.8 | 6 |
| 8 | 43.5 | 56.5 | 6 |
| 9 | 10.5 | 89.5 | 15 |
| 10 | 10.8 | 44.6 | 3 |
| | | 44.6 | 15 |
| 11 | 16 | 84 | 5.5 |
| 12 | 15 | 42.5 | 3 |
| | | 42.5 | 6 |
| 13 | 11 | 89 | 11 |
| 14 | 11 | 29.7 | 3 |
| | | 59.3 | 15 |
| 15 | 80 | 20 | 6 |
| 16 | 65 | 35 | 6 |
| 17 | 65 | 35 | 6 |
| 18 | 65 | 35 | 6 |
| 19 | 50 | 50 | 6 |
| 20 | 70 | 30 | 6 |
| 21 | 70 | 30 | 3 |
| 22 | 60 | 40 | 3 |

The basis weight, thickness, and density, were determined for each fabric. The results are set forth in Table II.

TABLE II

| Example | Basis weight (g/m) | Thickness (cm) | Density ($kg/m^3$) |
|---|---|---|---|
| 1 | 80 | 0.16 | 50 |
| 2 | 80 | 0.40 | 20 |
| 3 | 110 | 0.69 | 16 |
| 4 | 200 | 0.91 | 22 |
| 5 | 200 | 0.91 | 22 |
| 6 | 211 | 2.11 | 10 |
| 7 | 161 | 1.29 | 12.5 |
| 8 | 136 | 0.85 | 16 |
| 9 | 188 | 1.22 | 15.4 |
| 10 | 183 | 1.21 | 15.1 |
| 11 | 150 | 2.34 | 6.4 |
| 12 | 170 | 2.57 | 6.6 |
| 13 | 165 | 2.33 | 7.1 |
| 14 | 165 | 2.56 | 6.4 |
| 15 | 99 | 0.35 | 28.3 |
| 16 | 103 | 0.50 | 20.8 |
| 17 | 101 | 0.43 | 23.5 |
| 18 | 109 | 0.53 | 20.5 |
| 19 | 107 | 0.66 | 16.2 |
| 20 | 80 | 0.48 | 16.7 |
| 21 | 86 | 0.49 | 17.5 |
| 22 | 109 | 0.72 | 15.2 |

The thermal resistance of each fabric was determined as actual thermal resistance, thermal resistance based on fabric thickness and thermal resistance based on fabric basis weight.

TABLE III

| | 41C49C4:E@?K19I21C29C31C39C41C49C4:E{ | | |
|---|---|---|---|
| Example | (clo) | (clo/cm) | ($clo\text{-}m^2/kg$) |
| 1 | 0.37 | 2.3 | 4.6 |
| 2 | 0.74 | 1.8 | 9.2 |
| 3 | 1.13 | 1.6 | 10.3 |
| 4 | 1.41 | 1.5 | 7.0 |
| 5 | 1.42 | 1.5 | 7.1 |

TABLE III-continued

| Example | 41C49C4:E@?K19I21C29C31C39C41C49C4:E{ (clo) | (clo/cm) | (clo-m²/kg) |
|---|---|---|---|
| 6 | 2.50 | 1.2 | 12.3 |
| 7 | 1.80 | 1.4 | 11.1 |
| 8 | 1.30 | 1.5 | 9.5 |
| 9 | 1.46 | 1.2 | 7.8 |
| 10 | 1.85 | 1.5 | 10.1 |
| 11 | 2.63 | 1.1 | 15.0 |
| 12 | 2.98 | 1.2 | 14.8 |
| 13 | 3.17 | 1.4 | 18.8 |
| 14 | 2.61 | 1.0 | 13.2 |
| 15 | 0.64 | 1.8 | 6.5 |
| 16 | 0.86 | 1.7 | 8.4 |
| 17 | 0.82 | 1.9 | 8.1 |
| 18 | 0.96 | 1.8 | 8.8 |
| 19 | 1.01 | 1.5 | 9.5 |
| 20 | 0.75 | 1.5 | 9.2 |
| 21 | 0.42 | 0.8 | 4.9 |
| 22 | 1.13 | 1.6 | 10.4 |

The force to stretch each fabric 40 percent was determined in both the machine direction (MD), i.e., the direction of fabric formation, and in the cross direction (CD), i.e., perpendicular to the machine direction for the fabrics of Examples 9–22. The results are set forth in Table IV.

TABLE IV

| Example | Force to Stretch 40% (g) MD | CD |
|---|---|---|
| 9 | 1020 | 580 |
| 10 | 940 | 440 |
| 11 | 280 | 150 |
| 12 | 260 | 180 |
| 13 | 340 | 260 |
| 14 | 200 | 250 |
| 15 | 1250 | 1050 |
| 16 | 910 | 831 |
| 17 | 1230 | 880 |
| 18 | 952 | 790 |
| 19 | 760 | 587 |
| 20 | 1824 | 1320 |
| 21 | >2000 | >2000 |
| 22 | >2000 | >2000 |

Fabric samples of Examples 9–22 were tested for launderability. Launderability was determined by subjecting fabric samples to the equivalent of ten laundry cycles in a Maytag TM home washer using 90 minutes of continuous agitation with warm water and a gentle cycle, followed by normal rinse and spin cycles. The fabric samples were dried in a Whirlpool TM home dryer at medium heat on the permanent press setting after each laundry cycle. The fabrics were tested for percent retention of thermal resistance, percent retention of thickness, and percent average shrinkage. The results are set forth in Table V.

TABLE V

| Example | Retention of thermal resistance (%) | Retention of thickness (%) | Average shrinkage (%) |
|---|---|---|---|
| 9 | 86.2 | 80 | 2.8 |
| 10 | 76.7 | 76 | 3.6 |
| 11 | 74.0 | 59 | 6.5 |
| 12 | 65 | 50 | −2.0 |
| 13 | 58 | 45 | −2.7 |
| 14 | 60 | 52 | 0.3 |
| 15 | 116 | 122 | 4.5 |
| 16 | 113 | 105 | 6.7 |
| 17 | 113 | 106 | 5.7 |
| 18 | 103 | 102 | 7.7 |
| 19 | 109 | 99 | 6.4 |
| 20 | 107 | 77 | 3.5 |

TABLE V-continued

| Example | Retention of thermal resistance (%) | Retention of thickness (%) | Average shrinkage (%) |
|---|---|---|---|
| 21 | 171 | 94 | 4.3 |
| 22 | 82 | 76 | 5.3 |

The various modifications and alterations of this invention will be apparent to those skilled in the art without departing from the scope and spirit of this invention and this invention should not be restricted to that set forth herein for illustrative purposes.

What is claimed is:

1. A nonwoven thermal insulating stretch fabric comprising 10 to 90 weight percent elastomeric melt blown microfiber web, the microfibers having an average diameter of less than about 25 micrometers, and about 10 to 90 weight percent crimped bulking fibers, the microfibers being bonded to the bulking fibers at points of contact and the fabric having substantially uniform stretch properties such that the fabric will recover to within about 10 percent of the original dimensions within one hour after being elongated to 125 percent of the original length.

2. The fabric of claim 1 wherein said elastomeric melt blown microfibers comprise thermoplastic elastomeric materials.

3. The fabric of claim 2 wherein said thermoplastic elastomeric materials are elastomeric polyurethanes, elastomeric polyesters, elastomeric polyamides, elastomeric A-B-A′ block copolymers wherein A and A′ are styrenic moieties and B is an elastomeric midblock, or combinations thereof.

4. The fabric of claim 2 wherein said thermoplastic elastomeric material is an elastomeric polyurethane material.

5. The fabric of claim 1 wherein the average diameter of the microfiber is between about 3 and 12 micrometers.

6. The fabric of claim 1 wherein said crimped bulking fibers are natural and synthetic staple fibers.

7. The fabric of claim 1 wherein said crimped bulking fibers are polyester, acrylic, polyolefin, polyamide, rayon, or acetate staple fibers.

8. The fabric of claim 1 wherein said crimped bulking fibers have an average of more than about one half crimp per centimeter.

9. The fabric of claim 1 wherein said crimped bulking fibers have an average crimp frequency of at least two crimps per centimeter.

10. The fabric of claim 1 wherein said crimped bulking fibers preferably have an average length of between about 2 and 15 cm.

11. The fabric of claim 1 wherein said crimped bulking fibers are at least about 3 denier.

12. The fabric of claim 1 wherein said fabric comprises 25 to 75 weight percent elastomeric melt blown microfibers and 25 to 75 weight percent crimped bulking fibers.

13. The fabric of claim 1 wherein said elastomeric melt blown microfibers have an average diameter of less than about 15 micrometers.

14. The fabric of claim 1 wherein said fabric has thermal resistance of at least 0.9 clo/centimeter.

15. The fabric of claim 1 wherein said fabric has a thermal insulating efficiency by weight of at least $8\times10^{-3}$ clo−m²/gram.

16. The fabric of claim 1 wherein said fabric retains greater than 50% of its original thickness and thermal insulation efficiency after laundering or dry cleaning.

17. The fabric of claim 1 wherein said fabric retains greater than 75% of its original thickness and thermal insulation efficiency after laundering or dry cleaning.

* * * * *

UNITED STATES PATENT AND TRADEMARK OFFICE

CERTIFICATE OF CORRECTION

PATENT NO. : 4,908,263

DATED : Mar. 13, 1990

INVENTOR(S) : John F. Reed, Daniel E. Meyer, Thomas P. Hanschen

It is certified that error appears in the above-identified patent and that said Letters Patent is hereby corrected as shown below:

Col. 6, line 37, Basis Weight "(g/m)" should read --($g/m^2$)--

Signed and Sealed this

Second Day of April, 1991

*Attest:*

HARRY F. MANBECK, JR.

*Attesting Officer*

*Commissioner of Patents and Trademarks*